US007399240B2

(12) United States Patent
Paukert et al.

(10) Patent No.: US 7,399,240 B2
(45) Date of Patent: Jul. 15, 2008

(54) BASKETBALL SKILL GUIDE

(76) Inventors: Michael S. Paukert, 3505 Hazelwood La. SW., Rochester, MN (US) 55902; Dorothy A. Paukert, 3505 Hazelwood La. SW., Rochester, MN (US) 55902

( * ) Notice: Subject to any disclaimer, the term of this patent is extended or adjusted under 35 U.S.C. 154(b) by 115 days.

(21) Appl. No.: 11/328,644

(22) Filed: Jan. 10, 2006

(65) Prior Publication Data

US 2006/0154753 A1 Jul. 13, 2006

Related U.S. Application Data

(60) Provisional application No. 60/642,540, filed on Jan. 10, 2005.

(51) Int. Cl.
*A63B 69/00* (2006.01)

(52) U.S. Cl. ..... 473/450; 128/878

(58) Field of Classification Search ..... 473/450, 473/422, 464, 277, 212–217, 458; 602/21; D24/190

See application file for complete search history.

(56) References Cited

U.S. PATENT DOCUMENTS 1,728,679 A * 9/1929 Hansard ..... 473/213
3,152,337 A * 10/1964 Barry ..... 2/159
3,327,703 A * 6/1967 Gamm ..... 602/21
3,344,436 A * 10/1967 Stubbs ..... 2/159
4,441,490 A * 4/1984 Nirschl ..... 602/21
4,584,993 A * 4/1986 Nelson ..... 602/21
RE32,566 E * 12/1987 Patton, Jr. ..... 2/16
4,899,763 A * 2/1990 Sebastian et al. ..... 128/878
5,064,198 A * 11/1991 Szabo ..... 473/213
5,685,787 A * 11/1997 Kogut ..... 473/409
6,514,163 B2 * 2/2003 Burns ..... 473/458

* cited by examiner

*Primary Examiner*—Gene Kim
*Assistant Examiner*—M Chambers
(74) *Attorney, Agent, or Firm*—Quarles & Brady, LLP

(57) ABSTRACT

The invention is a basketball training device for training players of all ages and skill levels how to shoot a basketball and/or how to play defense. The device comprises at least one elongated piece of substantially flexible material having two opposing ends, the ends secured together to define a substantially circular flexible device, the device being worn around a player's legs, wrists and/or hands. The device provides tension and support to the player's legs, wrists and/or hands, wherein the tension keeps the player's legs, wrists and/or hands in a desired basketball position. In a preferred version, the tension further provides at least some degree of feedback to the player when the player's legs, wrists and/or hands assume an undesired basketball position. The device may be used to train a player in offense (i.e., shooting) as well as defense.

4 Claims, 4 Drawing Sheets

BASKETBALL SKILL GUIDE

CROSS-REFERENCE TO RELATED APPLICATIONS

This application claims priority under 35 USC §119(e) to U.S. Provisional Appn. Ser. No. 60/642,540, filed Jan. 10, 2005, the entirety of which is hereby incorporated herein.

FIELD OF THE INVENTION

This document concerns an invention relating generally to a training device for teaching basketball skills, and particularly to a device for training a player how to shoot a basketball and how to play defense.

BACKGROUND

Basketball contains a variety of offensive and defensive skills which are difficult to learn, and especially difficult to master. One of the most important offensive skills to master is how to properly shoot the ball. Good shooting requires a player properly (and consistently) position the shooting hand underneath and around the ball. The proper shooting technique requires the thumb and forefinger of the player's shooting hand be positioned at an approximately 60 degree angle on the ball. The player's shooting hand is preferably positioned approximately 45 degrees to 65 degrees away from the player's forearm. The player's other hand (described herein as the "guide hand") helps support or balance the ball, but does not enter into the actual shooting of the ball. The guide hand ideally comes off the ball just before the ball is released, but the guide hand should remain high, near the player's head.

If the player's fingers are in the wrong position in relation to the thumb; if the player's shooting hand is in the wrong position in relation to the player's forearm (i.e., the hand is cocked too far back or not far enough); if the player's guide hand is too close or too far away from the ball when the ball is released for a shot; or if the player's guide hand does not face player's shooting hand, the player will not have proper shooting technique. However, it is difficult for a player to watch and adjust the position of their hands when shooting. Also, it is hard for coaches and teachers to see what a player is doing wrong when shooting.

Thus, a variety of tools exist to train a player to shoot, and to allow coaches to better trouble-shoot a player's shot. Many of these tools are worn on a player's arms and/or elbows. However, a need exists for a basketball training device that is worn on the player's hands that immediately informs a player and/or teacher when the when the player is using improper shooting technique.

Similarly, one of the most important defensive skills to learn and to master is the proper defensive stance. In a proper defensive stance, the player is preferably balanced forward, knees bent, with the player's weight on the balls of the feet, with the feet about shoulder-width apart. The knees should be bent and the back straight. When moving in the defensive stance, the player should slide the feet sideways, using quick, short steps. While this may sound simple, when a player is tired, defense is often the first skill to fail. Tired players often don't keep their knees bent enough and tend to reach more with their arms, thus committing more fouls. Further, players often don't realize how much their defensive stance is suffering, regardless of how often the coach yells at them.

Thus, a variety of tools exist to train a player to play defense, even when tired, and to provide instantaneous feedback to a player when the defensive stance fails. Many of these tools are very complex items with multiple parts. Further, they are often bulky, expensive and uncomfortable. Therefore, a need exists for a simple yet comfortable basketball training device that immediately informs a player when the player is using in a poor defensive stance.

BRIEF SUMMARY OF THE INVENTION

The invention provides a basketball training device for training players of all ages and sizes how to shoot a basketball and how to play defense. The present invention provides a basketball training device comprising at least one elongated piece of substantially flexible material having two opposing ends, the ends preferably fixedly secured together to define a substantially circular support. The training device may be worn, either alone or in combination, around a player's legs, wrists and/or hands. The device provides tension and support to the player's legs, wrists and/or hands, wherein the tension keeps the player's legs, wrists and/or hands in a desired basketball position. In a preferred version, the tension further provides at least some degree of feedback to the player when the player's legs, wrists and/or hands assume an undesired basketball position. The training device may be used to train a player in offense (i.e., shooting) as well as defense.

In a first embodiment, the present invention provides an improved basketball training device comprising an elongated, substantially flexible piece having two opposing ends, the ends fixedly secured together to define a substantially circular support secured about a player's legs. The training device is preferably dimensioned and configured to provide constant tension to the player's legs when the player is in the proper defensive stance. Accordingly, the training device is preferably positioned above the player's upper calves, just below the player's knees.

In a second embodiment, the present invention provides an improved basketball training device comprising two elongated, substantially flexible pieces, each piece having two opposing ends secured together. A first elongated piece is preferably dimensioned and configured to provide constant tension to a player's wrist. The wrist piece is preferably secured to a second elongated piece dimensioned and configured to provide constant tension to a player's hand. The end pieces of the hand piece are preferably secured together to define a 45 degree seam. Thus, when the hand and wrist pieces are secured together, a substantially 45 degree angle is defined between the hand and wrist pieces. The wrist piece is preferably secured to the hand piece at a player's outer wrist bone (i.e., the wrist bone closest to the player's little finger).

When worn about a player's wrist and/or hands, the wrist piece preferably combines with the hand piece to provide sufficient tension to position the player's thumb approximately 60 degrees away from the player's forefinger. Further, the wrist piece preferably combines with the hand piece to provide sufficient tension to position the player's hand between 45 and 60 degrees away from the player's forearm.

In a third embodiment, the basketball training device is worn on the player's shooting and guide hands at the same time and is connected by a releasable connector piece. The connector piece is preferably comprised of an elongated piece of substantially flexible material having two opposing ends. Each end is preferably releasably attached to each training device at the player's inner wrist bone. In a preferred version, the connector piece is releasably attached to the training devices using hook and loop fasteners. However, other forms of attachments including but not limited to snaps, zippers, hooks, and the like are also envisioned by the scope of this invention.

The present invention also provides a method of training a player to shoot a basketball. The method comprises inserting the training device comprising the combined hand and wrist pieces onto at least one of the player's hands so as to provide constant tension to the player's hand and wrist while shooting a basketball. The device is preferably positioned so that the 45 degree seam between the hand and wrist pieces is on the player's outer wrist bone. While shooting, the training device provides instant feedback to the player as to the position of the player's hands, fingers, and thumbs.

A method of training a player the proper defensive stance is also provided, wherein the player inserts a training device comprising a single, elongate piece of substantially flexible material around a player's legs just below the player's knees, assuming the proper defensive stance (i.e., the player is balanced forward, knees bent, with the player's weight on the balls of the feet, and the feet about shoulder-width apart) and moving in a defensive stance (i.e., the player slides the feet sideways, using quick, short steps, keeping the knees bent). While in the proper defensive stance, the training device remains in position on the player's legs. However, as the player's defensive stance changes, the training device provides instantaneous feedback to the player.

The basketball training device of the present invention may be also be worn about a player's legs and hands/wrists at the same time. For instance, a player can practice the proper defensive stance while wearing the training device about the hands and wrists.

The basketball training device of the present invention is well suited for use by player's of all ages, sizes and skill levels. It is a simple and easy to wear device that trains a player to be aware of the position of their hands, fingers and wrists when shooting and the position of their knees, thighs and legs when defending. Further, the device provides clear and convincing feedback to the player as well as any coaching or training staff. By positioning the training device around a player's legs, hands and/or wrists in the preferred positions, an improved basketball training device is provided.

The foregoing and other advantages of the invention will become apparent from the following description. In the following description reference is made to the accompanying drawings, which show preferred embodiments of the invention. However, these embodiments do not represent the full scope of the invention. Reference should therefore be made to the claims at the end of this document for interpreting the scope of the invention.

DETAILED DESCRIPTION OF THE PREFERRED EMBODIMENTS

The following description refers to a "proper" technique for shooting and defense. While other techniques for shooting and defending may exist, the techniques and/or positions described herein are generally considered to be "proper" in the field.

Figure 1:
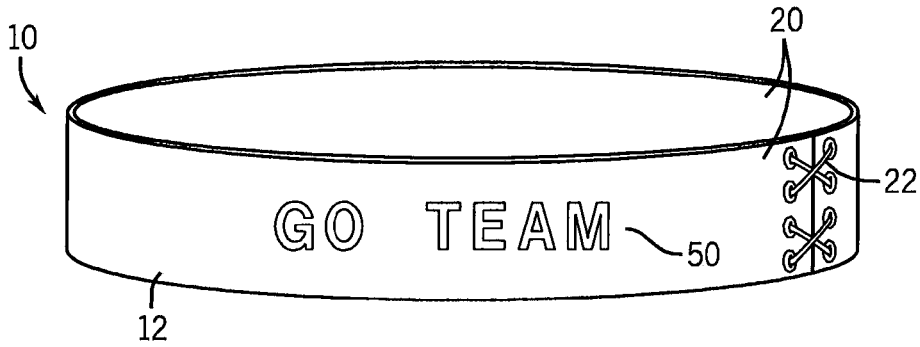
FIG. 1 is a front view of the basketball training device of the present invention.

Referring to FIG. 1, the simplest embodiment of the training device 10 of the present invention is shown. The training device 10 may be worn about a player's legs 14, wrists 16 and/or hands 18. For the sake of clarity, the device 10 is referred throughout the present document based on where the device 10 is worn by the player. For instance, when worn about the player's legs 14, it is known as the leg piece 15. When worn about the player's wrist 16, it is known as the wrist piece 17. When worn about the player's hand 18, it is known as the hand piece 19.

Alone or in combination, the device 10 comprises at least one substantially elongated piece 12 of a firm yet flexible material such as elastic. The two opposing ends 20 of the elastic piece 12 are preferably fixedly secured together at a seam 22 to define a circular member dimensioned and configured to provide constant tension and feedback to a player. The seam 22 can be straight (i.e., both ends 20 are flush together when secured) or at an angle (i.e., both ends 20 are angled together when secured). The device 10 may also contain a label 50 such as a team logo, motivational saying, and the like.

Figure 2:
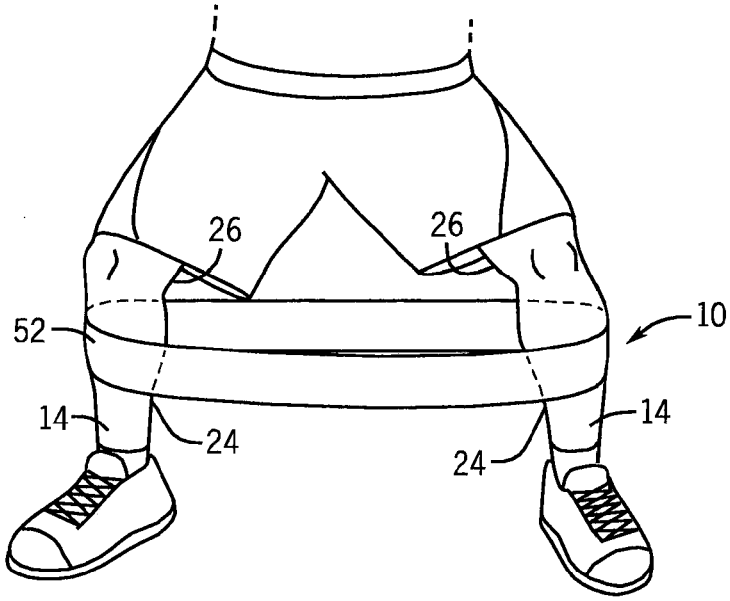
FIG. 2 is a front view of the training device worn about a player's legs.

Referring to FIG. 2, the training device 10 can be seen worn about a player's lower legs 14. The leg piece 15 preferably comprises a single substantially elongated piece 12 of a firm yet flexible material such as elastic. The two opposing ends (not shown) of the leg piece 15 are preferably fixedly secured together at a seam (also not shown) to define a circular member dimensioned and configured to provide constant tension and feedback to a player's legs 14. The ends of the leg piece 15 are preferably brought together in a straight seam.

In use, the leg piece 15 is preferably positioned tightly about a player's lower legs 14, so that the entire length of the leg piece 15 is in constant contact with the player's legs 14. In a preferred version, the leg piece 15 is positioned about the player's upper calves 24 just below the player's knees 26.

When the player is in the proper defensive stance, (i.e., legs apart, knees bent, and the player's weight is balanced on the balls of their feet), the training device 10 has sufficient tension to stay in the proper position around the player's legs 14. However, when the player's legs 14 are too close together or too far apart, or when the player's knees 26 are bent too much or not enough, the tension on the training device 10 changes. As the tension changes, the training device 10 moves up or down the player's legs 14, out of the proper position. In this manner, the training device 10 provides instantaneous feedback to the player as to their defensive stance.

Figure 3:
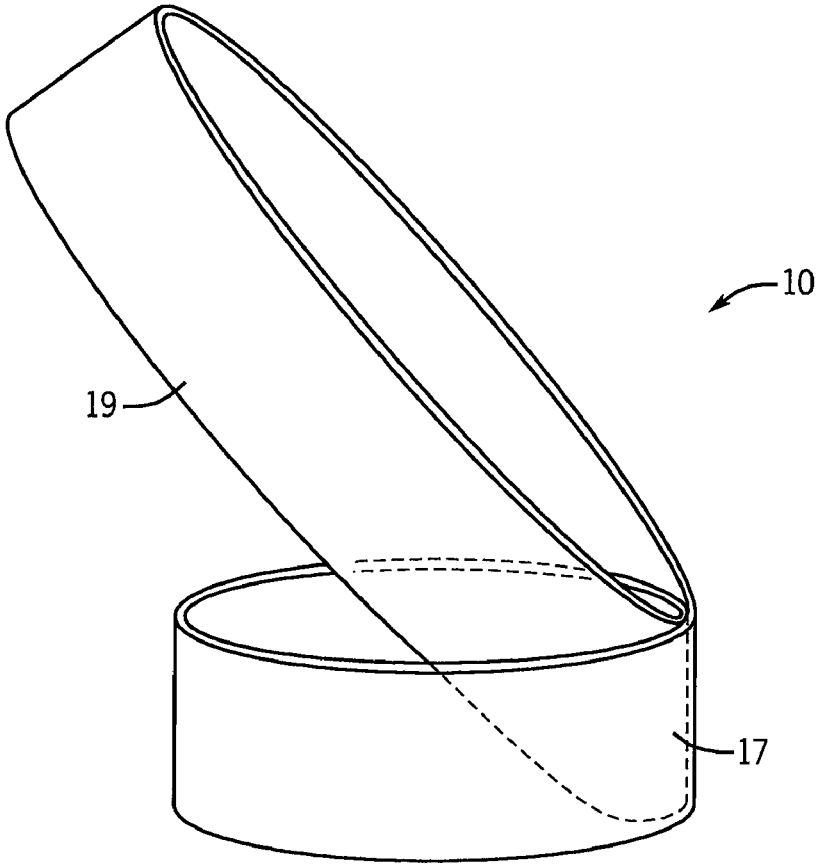
FIG. 3 is a front view of two of the training devices of FIG. 1 adapted for use around a player's hand and wrist.
Figure 4:
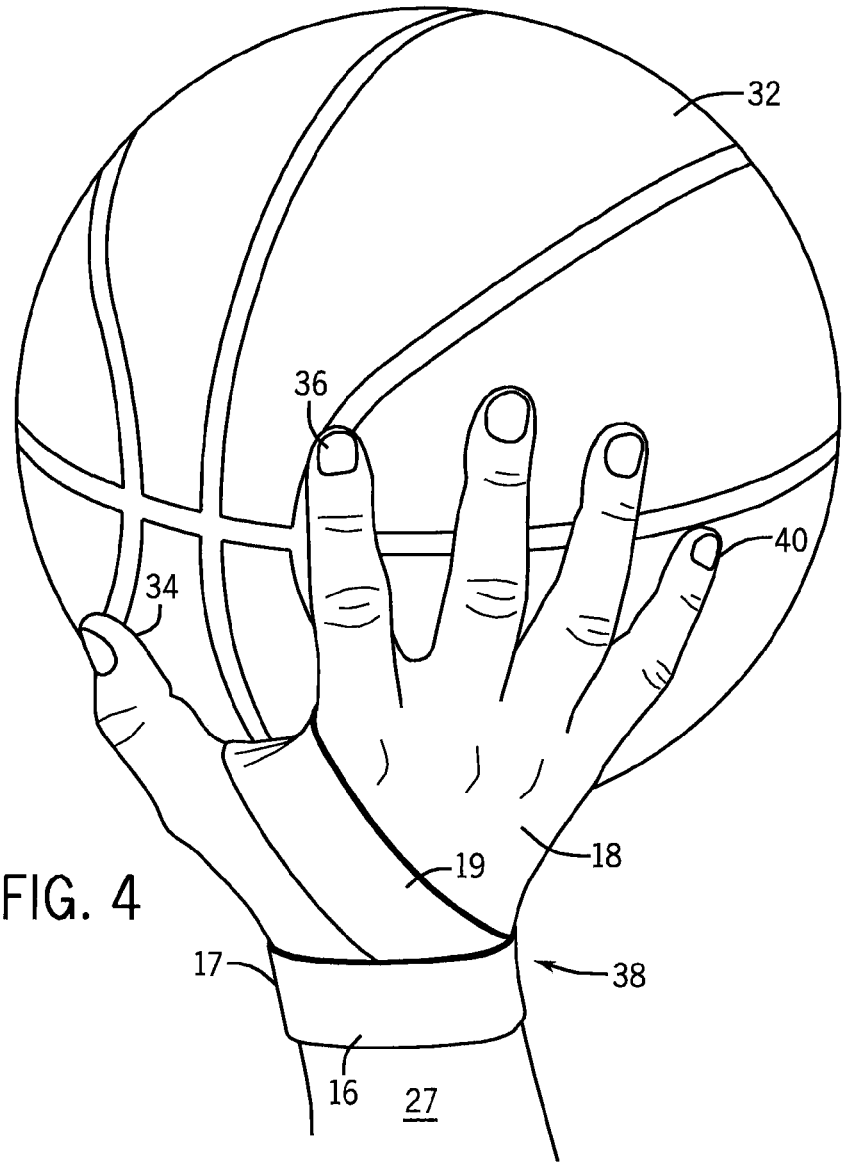
FIG. 4 is a front view of the training device of FIG. 3 worn about a player's wrist and hand.

Referring now to FIGS. 3 and 4, a basketball training device 10 used to train a player how to shoot a basketball is shown. The training device 10 comprises two elongated pieces 12 of a substantially flexible material, each piece having two opposing ends, the pieces 12 combined to provide a hand and wrist support. A first elongated wrist piece 17 is combined with a second elongated hand piece 19.

In a preferred version, two opposing ends (not shown) of the first elongated wrist piece 17 are fixedly secured together to define a substantially circular piece dimensioned and configured to conform around a player's wrist 16 in such a manner as to provide constant tension to the player's wrist 16. The ends (not shown) of the wrist piece 17 are preferably secured together to define a straight seam (not shown).

Two opposing ends (not shown) of the hand piece 19 are also preferably fixedly secured together. However, the ends of the hand piece 19 are preferably secured together so as to define a substantially 45 degree seam (not shown) between the two ends. This defines an elongated, substantially circular piece dimensioned and configured to conform around a player's hand 18. In use, the hand piece 19 stretches from between the player's thumb 34 and forefinger 36 to the player's outer wrist bone 38 (i.e., the wrist bone closest the player's little finger 40). The hand piece 19 preferably provides constant tension to the player's hand 18.

The wrist and hand pieces 17 and 19 are preferably fixedly secured together at the players outer wrist bone 38 to define an approximately 45 degree angle between the wrist piece 17 and the hand piece 19.

In use, the training device 10 may be worn on one or both of a player's hands 18. The training device 10 is preferably inserted onto a player's hand 18 and wrist 16 until the wrist piece 17 is secured about the player's wrist 16 and the hand piece 19 is secured about the player's hand 18. The hand piece 19 is preferably placed across the player's hand 18 in a substantially diagonal manner. Once in position, the hand piece 19 preferably stretches from the player's outer wrist bone 38, across the back of the player's hand 18, between the player's thumb 34 and forefinger 36, and back around the palm (not shown) of the player's hand 18 to the outer wrist bone 38.

The seam (not shown) connecting the wrist and hand pieces 17 and 19 is preferably positioned at the player's outer wrist bone 38. In a preferred version, the seam is positioned on the exterior of the device 10, facing away from the player. This prevents the seam from chafing against the player's skin.

When in the proper position, the basketball training device 10 of the present invention provides constant tension on the player's hand 18 and wrist 16. In a preferred version, the device 10 provides sufficient tension to position a player's thumb 34 approximately 60 degrees away from the player's forefinger 36, and a player's hand 18 approximately 45 to 60 degrees away from the player's forearm 27. Thus, when the player uses improper shooting technique (i.e., the thumb 34 and forefinger 36 are too close together or too far apart, or the player's hand 18 is cocked too far back towards the forearm 27 or not far enough), the tension of the training device 10 on the player's hand 18 and/or wrist 16 increases. In this manner, a comfortable, easy-to-wear training device 10 that instantaneously tells a player when the player is using improper shooting technique is provided.

Figure 5:
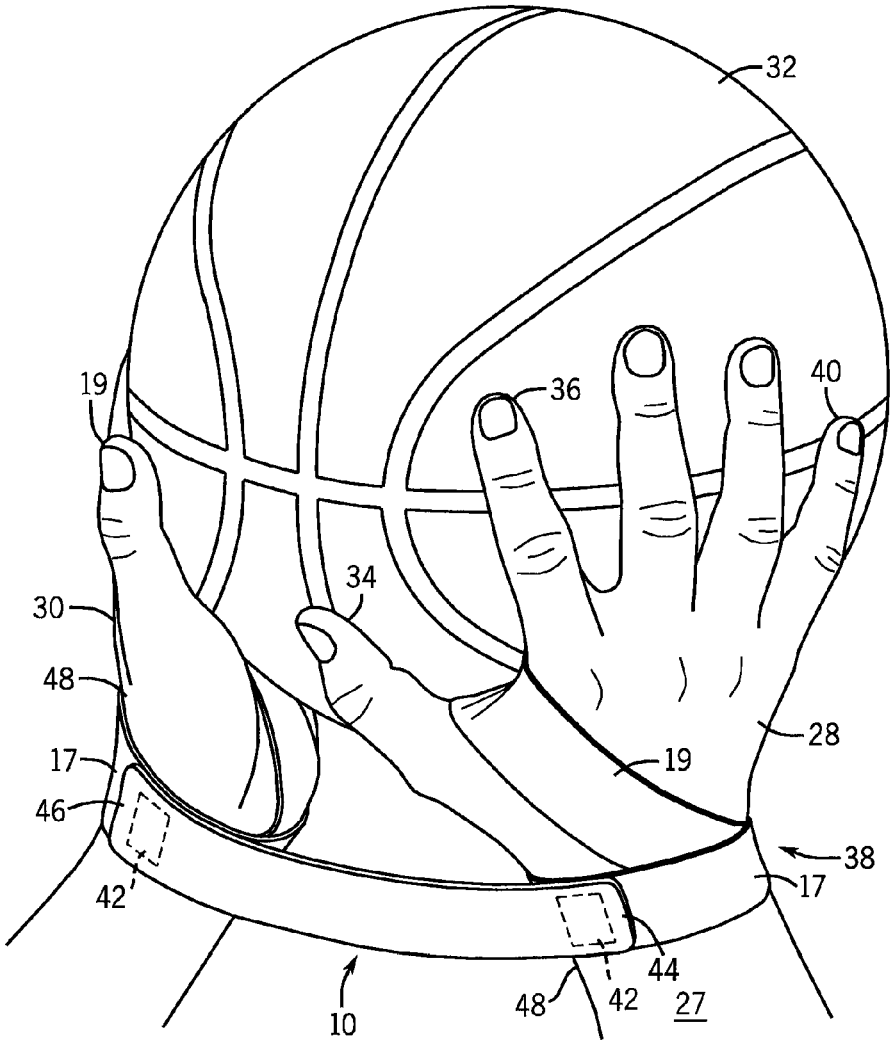
FIG. 5 is a front view of two of the training devices of FIG. 3 worn about a player's two hands, the devices connected by an elongated connector piece.

The training device 10 of the present invention may be worn on one or both of a player's hands 18. Referring now to FIG. 5, the training device 10 of the present invention is seen worn on the player's shooting hand 28 as well as on the player's guide hand 30. When a player is wearing the training device 10 on both hands 28 and 30, the player can focus on the position of the shooting hand 28 (i.e., proper placement of the forefinger 36, thumb 34 and wrist 16) as well as the position of the opposing guide hand 30. For instance, when the player's guide hand 30 is too high or too low on the ball 32, the device 10 provides and increased amount of tension on the player's guide hand 30.

Additionally, when the training device 10 is worn on both hands 28 and 30 at the same time, the training devices 10 may be connected to each other using a releasably attached connector piece 42. The connector piece 42 is preferably an elongated piece of substantially flexible material having two opposing ends 44 and 46. In a preferred version, each end 44 and 46 is releasably attached to a training device 10. The connector piece 42 is preferably releasably attached to each device 10 where the device 10 crosses the player's inner wrist bone 48 (i.e., the wrist bone closest to the player's thumb 34). While in a preferred version the connector piece 42 is releasably attached to the training devices 10 using hook and loop fasteners, any means of attachment may be used, including snaps, buttons, hooks, and the like.

In use, a player wearing a training device 10 configured for the player's shooting hand 28 can be releasably attached to the elongated connector piece 42, which in turn is releasably attached to a second training device 10 worn on the player's guide hand 30. When the player's guide hand 30 is in the improper position (i.e., too high or too low) after shooting, the connector piece 42 will be pulled off one or both of the training devices 10.

The present invention also provides a method of training a player to shoot a basketball 32. The method comprises positioning the combined wrist and hand pieces 17 and 19 onto at least one of the player's hands 18 so as to provide constant tension to the player's wrist 16 and hand 18 while shooting the basketball 32. The device 10 is preferably positioned so that the 45 degree seam between the wrist and hand pieces 17 and 19 is on the player's outer wrist bone 38. In alternate versions, a connector piece 42 may be releasably attached at both ends 44 and 46 to a training device 10. While shooting, the training device 10 preferably provides instantaneous feedback to the player as to the position of the player's hand 18 by moving out of position on the player's hand 18 and wrist 16. When using a connector piece 42, the connector piece 42 will be detached from one or both of the combined wrist and hand pieces 17 and 19 when the player's shooting hand 28 or guide hand 30 is out of position.

A method of training a player the proper defensive stance is also provided. The method comprises positioning the leg piece 15 around the player's legs 14 just below the player's knees 26, assuming the proper defensive stance (i.e., the player is balanced forward, knees 26 bent, with the player's weight on the balls of the feet, and the feet about shoulder-width apart) and moving in a defensive stance (i.e., the player slides the feet sideways, using quick, short steps, keeping the knees bent). While in the proper defensive stance, the leg piece 15 remains in position on the player's legs 14. However, as the player's defensive stance changes, the leg piece 15 provides instantaneous feedback to the player.

The basketball training device of the present invention is preferably adapted for use by players of all ages and sizes. Accordingly, the dimensions of the training device 10 depend on the needs of the individual player. For instance, the wrist piece 17 is long enough to fit securely around a player's wrist 16; the hand piece 19 is long enough to fit securely around a player's hand 18; and the leg piece 15 is long enough to fit securely around a player's legs 14. In a preferred version, the wrist piece is preferably about one to two inches wide and two to seven inches long; the hand piece is preferably about one to two inches wide and four to ten inches long; and the leg piece 15 is preferably about one to two inches wide and eight to twenty inches long. The connector piece 42 is preferably about one to two inches wide and eight to fourteen inches long. The dimensions of each piece can increase or decrease depending on the size of the user.

The flexible material used in the present invention is preferably a firm yet flexible elastic material. Thus, a medium grade elastic material is preferred. However, other substantially flexible materials may be used so long as the material provides sufficient tension to keep the device in place about a player's legs, wrists and/or hands and provide feedback to the player.

Feedback is provided when the device 10 moves out of the proper position on the player. For instance, when teaching defense, the device 10 will ride up or down the player's legs as the incorrect degree of tension is applied. Only in the proper defensive stance will the training device 10 remain in position on the player's upper calves. When teaching shooting, the device 10 will roll, crinkle, or otherwise move out of position when the player's hands, fingers and thumbs are in the improper position.

The ends of each leg, wrist and hand piece 15, 17 and 19 are preferably fixedly secured together using any means known to the art. In a preferred version, the ends are sewn together with heavy thread. However, a one-piece circular member without any seams is also envisioned by this invention. Further, the ends of each leg, wrist and hand piece 15, 17 and 19 may also be releasably or adjustably secured together. For instance, a series of hooks, snaps, buttons and the like may be positioned on the ends of each piece 15, 17 and 19 so that as the player grows, the leg, wrist and hand pieces 15, 17 and 19 grow with them.

The basketball training device 10 may also be substantially enclosed in a flexible outer casing 52 made of lightweight material such as knit or felt. The casing 52 increases the durability and appearance of the device 10 by preventing the elastic member from fraying or losing its elasticity. Further, the device 10 and/or casing 52 may contain a decorative label 50, such as for advertising or marketing purposes. For instance, the casing 52 may contain a team logo or other motivational sayings.

While preferred embodiments of the present invention have been described and otherwise disclosed herein, alternative embodiments are also intended to be within the scope of the claims. Thus, the invention is not to be judged solely by the preferred embodiments. Rather, the claims should be looked to in order to judge the full scope of the invention.

INDUSTRIAL APPLICABILITY

The present invention provides an improved basketball training device for training players of all ages or skill levels how to shoot a basketball and how to play defense.

What is claimed is:

1. A basketball training device comprising:

a first elongated wrist piece of elastic material having two opposing ends, wherein the ends are secured together at each end to define a substantially circular support dimensioned and configured to conform around a player's wrist;

a second elongated hand piece of elastic material having two opposing ends, wherein the ends are secured together at each end to define a substantially circular support dimensioned and configured to conform around a player's hand in a substantially diagonal path from the player's outer wrist bone to between a player's thumb and forefinger;

wherein the ends of the wrist piece are secured together at each end in a straight angle and the ends of the hand piece are secured together in a 45 degree angle;

wherein wrist piece is secured to the hand piece to define a substantially 45 degree angle between the wrist and hand pieces, wherein the wrist and hand pieces are secured together at the player's outer wrist bone wherein the wrist and hand pieces combine to provide sufficient tension to position the player's thumb approximately 60 degrees away from the player's forefinger; and wherein the wrist and hand pieces combine to provide sufficient tension to position the player's hand between 45 and 60 degrees from a player's forearm wherein the wrist piece is approximately 1.5 inches wide and 4 to 8 inches long and the hand piece is approximately 1.5 inches wide and 6 to 10 inches long and wherein the wrist and hand pieces are substantially enclosed in a flexible outer casing, whereby the casing increases the durability and appearance of each piece.

2. A basketball training device comprising:

a first and second basketball training device, wherein each device comprises:

a first elongated wrist piece of elastic material having two opposing ends, wherein the ends are secured together at each end to define a substantially circular support dimensioned and configured to conform around a player's wrist;

a second elongated hand piece of elastic material having two opposing ends, wherein the ends are secured together at each end to define a substantially circular support dimensioned and configured to conform around a player's hand in a substantially diagonal path from the player's outer wrist bone to between a player's thumb and forefinger;

wherein the ends of the wrist piece are secured together at each end in a straight angle and the ends of the hand piece are secured together at each end in a 45 degree angle;

wherein the wrist piece is secured to the hand piece to define a substantially 45 degree angle between the wrist and hand pieces;

wherein the wrist and hand pieces are secured together at the player's outer wrist bone wherein the wrist and hand pieces combine to provide sufficient tension to position the player's thumb approximately 60 degrees away from the player's forefinger;

wherein the wrist and hand pieces combine to provide sufficient tension to position the player's hand between 45 and 60 degrees from a player's forearm;

wherein the first basketball training device is dimensioned and configured to conform to a player's shooting hand;

wherein the second basketball training device is dimensioned and configured to conform to a player's guide hand; and an elongated connector piece of substantially elastic material;

wherein the first and second devices are releasably attached to each other at the player's inner wrist bones by the elongated connector piece.

3. The device of claim 2 wherein the connector piece is releasably attached to the training devices with a hook and loop fastener.

4. The device of claim 2 wherein the ends of the hand and wrist pieces are releasably secured together.

* * * * *